US005800290A

United States Patent [19]

Barry

[11] Patent Number: 5,800,290

[45] Date of Patent: Sep. 1, 1998

[54] ATHLETE PRACTICE SHOOTING AID DEVICE

[75] Inventor: Richard E. Barry, Stanhope, N.J.

[73] Assignee: Sports Advisor, Inc., New York, N.Y.

[21] Appl. No.: 796,768

[22] Filed: Feb. 6, 1997

[51] Int. Cl.[6] ..... A63B 63/04; A63B 63/08; A63B 69/00

[52] U.S. Cl. ..... 473/438; 473/446; 473/447

[58] Field of Search ..... 473/447, 438, 473/439, 446, 448, 454, 455, 462, 101, 132, 459, 470, 471, 476, 477, 478, 479, 480, 423; 273/392

[56] References Cited

U.S. PATENT DOCUMENTS

| | | | |
|---|---|---|---|
| 2,039,794 | 5/1936 | Hayden | 273/1.5 |
| 2,708,576 | 5/1955 | Verkuilen | 473/448 |
| 2,964,316 | 12/1960 | Rose | 273/26 |
| 2,978,246 | 4/1961 | Van Groningen | 273/26 |
| 3,160,414 | 12/1964 | Gray | 273/1.5 |
| 3,698,712 | 10/1972 | Pero | 473/454 |
| 4,206,915 | 6/1980 | Woodcock | 273/1.5 A |
| 4,226,416 | 10/1980 | Callanan | 273/1.5 A |
| 4,244,569 | 1/1981 | Wong | 273/1.5 A |
| 4,506,886 | 3/1985 | Lamb, Sr. | 273/1.5 A |
| 4,696,471 | 9/1987 | McGrath et al. | 473/462 |
| 4,842,283 | 6/1989 | LeBel et al. | 273/392 |
| 4,911,442 | 3/1990 | Monroe et al. | 473/462 |
| 4,915,381 | 4/1990 | Hackett | 273/1.5 A |
| 4,991,837 | 2/1991 | Deal | 273/1.5 R |
| 5,354,048 | 10/1994 | Winesberry, Jr. | 273/1.5 A |
| 5,390,912 | 2/1995 | Silagy | 273/15 A |
| 5,433,434 | 7/1995 | Helmetsie | 473/446 |
| 5,558,323 | 9/1996 | LaFaso, Sr. | 273/1.5 A |
| 5,603,495 | 2/1997 | Noveck | 473/447 |
| 5,628,515 | 5/1997 | Levy | 473/446 |

*Primary Examiner*—William H. Grieb
*Attorney, Agent, or Firm*—Pennie & Edmonds LLP

[57] ABSTRACT

An athletic shooting aid adapted to be detachably mounted directly on the goal of a sporting event to provide a target at which the player aims and strikes with the game piece in order to improve the form and accuracy of the player's shooting. The device comprises a clamp which is removably attachable to the goal having a substantially straight elongated member extending from the clamp with a ball or bulk of material attached to the elongated member to serve as the target at which the player aims when shooting the game piece. The elongated member is adapted and configured to allow the ball to move when struck by the game piece in such a manner that the game piece deflects the ball without substantially affecting the trajectory of the game piece and to allow the ball to be repositioned after the game piece has passed through the goal.

36 Claims, 3 Drawing Sheets

ATHLETE PRACTICE SHOOTING AID DEVICE

FIELD OF THE INVENTION

This invention relates to a shooting aid device connected to a goal, such as a basketball hoop, soccer goal, hockey goal, football goalposts, etc., having a target at which a player aims to improve his/her shooting form and accuracy.

BACKGROUND OF THE INVENTION

Various training devices have been designed in an attempt to improve the shooting accuracy of athletes in sporting events such as basketball, soccer, hockey, lacrosse, football, tennis, etc. At least two types of shooting aids have been proposed. The first type of shooting aid causes the game piece, i.e., the basketball, soccer ball, hockey puck, lacrosse ball, tennis ball, etc., to miss or deflect away from the goal thus allowing only highly accurate and desirable shots to score. The second type of shooting aid provides a visual target for the player to aim and shoot at when shooting at the goal.

One area in which many shooting aid devices have been attempted is basketball. One example of a basketball practice device which operates by deflecting shots with undesirable trajectories is U.S. Pat. No. 4,206,915 to Woodcock. This patent has as its principal object a device which will deflect shots having a flat trajectory and encourage shooters to place a higher arc or trajectory on a shot. The device has a C-ring adapted to attach to the basketball hoop with a plurality of radially, laterally extending legs which extend outwardly from the hoop about four to six inches. A free-standing member is mounted on each leg which projects at least about two to four inches over the rim. The free-standing member is positioned to deflect basketball shots having undesirable trajectories. The object and purpose of the free-standing members are for the shooter to aim and shoot over the free-standing members so that the shooter develops a high arcing shot. The disadvantage of this device is that it does not provide a visual target or focus point for the player to aim at when shooting the basketball. In addition, this device does not provide positive reenforcement when the player makes a proper shot, but rather it only indicates when the player has made an improper shot having a low, flat trajectory.

An example of the second type of shooting aid which provides a target is U.S. Pat. No. 4,244,569 to Wong which discloses a target in the form of a brightly colored ball which extends from the backboard at a position below the basketball rim or hoop to a position substantially immediately below and at the center of the basketball hoop. This apparatus has disadvantages in that the target is not easily visible in its position immediately below the rim and in the center of the hoop.

A different example of the second type of practice shooting aid is U.S. Pat. No. 4,506,886 to Lamb, Sr. which discloses a basketball practice apparatus which extends from the backboard at a position above the rim and positions a target ball above the rim and at the center of the hoop area. This basketball shooting apparatus has disadvantages inasmuch as the structure of the holding apparatus for the target impedes upon the utilization of the backboard and prevents utilizing the apparatus in a scrimmage or game situation.

It is an object of the present invention to provide a practice device which can be attached to a goal and aids in teaching players proper aim and shooting techniques. It is a further object of the invention to present a visual target which displays a clearly visible aiming or focus point. It is a further object of the invention to provide positive feedback to the shooter so that the shooter can perceive when he/she has taken a proper shot. It is a further object of the invention that the target be aimed at and struck by the game piece and that the target deflect upon impact with the game piece in a manner which does not substantially deflect the path or trajectory of the game piece.

It is a further object of the invention that the device be attached to a goal in a manner which does not interfere with play such that a scrimmage or game can be played with the target device attached to the goal. It is a still further object that, while the device may be attached to the goal during scrimmage or game play, after consistent usage an image or illusion of the target should or may appear to the player without the target practice apparatus actually in place.

More particularly, it is an object of the invention to provide a basketball practice shooting device for improving shooting accuracy which utilizes a target positioned above the front of the basketball rim to present an unobscured aiming or focus point for the shooter. It is an object of the basketball shooting device to teach the shooter to place his/her shots just above the front of the basketball rim.

Other objects and advantages of this invention will become apparent from the following description taken in conjunction with the accompanying drawings wherein different embodiments are set forth by way of illustration and example but should not be interpreted as a limitation upon the claims.

SUMMARY OF THE INVENTION

This invention involves a practice device which can be mounted on a goal, for example the rim of a basketball hoop, a hockey goal, a soccer goal, football goalposts, a tennis net, etc., and used to improve the sighting, placing, shooting and ideally the scoring skills of a player. The device comprises a base adapted to mount to the aforementioned goal which has extending linearly therefrom an elongated member which has attached thereto at the end distal from the base a bulk or ball of material acting as a target. The bulk or ball of material acts as the target for the shooter to aim at when shooting. The elongated member is designed so that when the player hits the target, the bulk or ball of material will deflect away without substantially affecting or altering the trajectory of the game piece. By hitting the target, the player receives positive feedback and a sense of an accurate, proper shot. In addition, the device does not substantially affect or interfere with the play of the game by deflecting the shot off-course or intruding upon the play of the game.

DETAILED DESCRIPTION OF THE INVENTION

Figure 1:
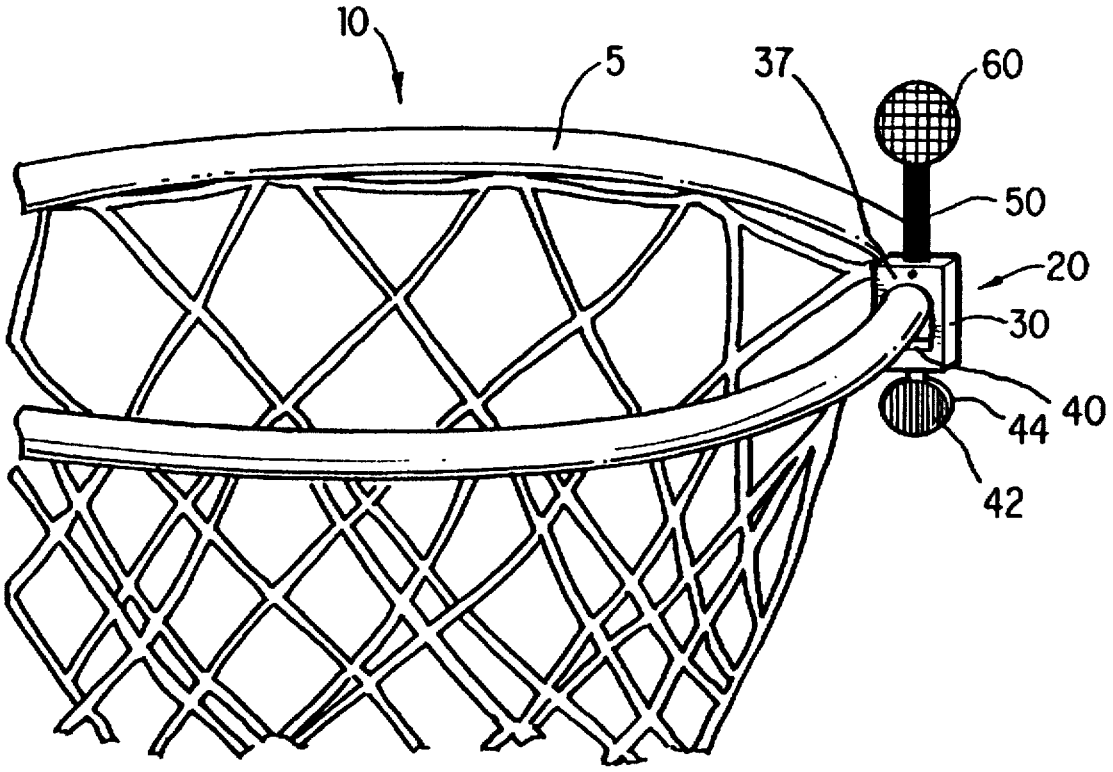
FIG. 1 illustrates a perspective view of the device according to the present invention mounted on the rim of a basketball hoop.

Referring to FIG. 1, a standard basketball goal or hoop 10 is mounted on a backboard (not shown) by means of a conventional bracketing arrangement (also not shown). Mounted on the rim 5 of the basketball goal or hoop 10 is one embodiment of the device 20 of the present invention. The term "goal" as used herein depends upon the sporting event referenced and is used in a broad general sense to refer to a basketball hoop, a soccer goal, football goalposts, a hockey goal and/or a tennis net as well as the supporting structure such as goalposts, crossbars, uprights, etc. In a similar manner, "game piece" is used in a general sense to refer to the object which is being shot, aimed, thrown or hit. For example, in hockey, the game piece would be the hockey puck (or ball); in basketball, the basketball; in tennis, the tennis ball; etc.

Figure 2:
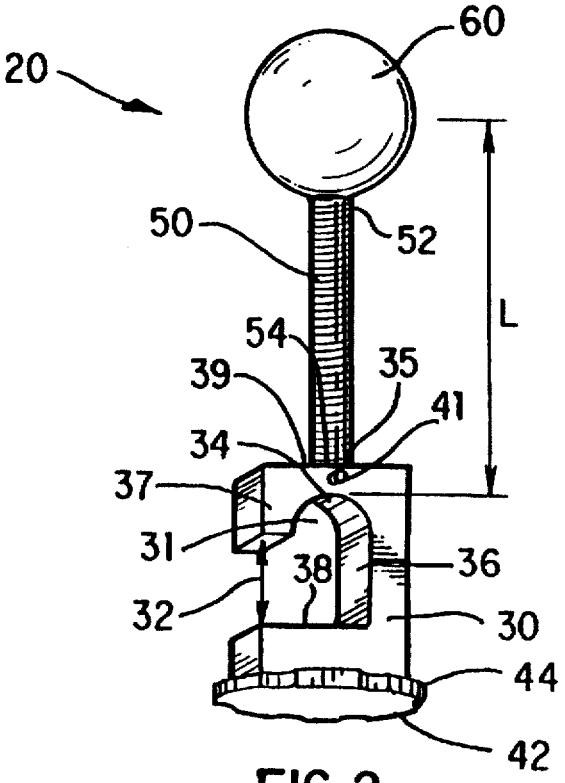
FIG. 2 illustrates a perspective view of a different embodiment of the device of FIG. 1.

Referring to FIGS. 1 and 2, the device 20 is attached to the basketball hoop 10 by means of a base or clamp 30. The clamp 30, when used to attach the device to a basketball rim, preferably has a modified C-shape which includes an opening 32 to allow the clamp to slide over the basketball rim 5 with an arcuately-shaped upper portion 34 which rests on top of the rim 5, a straight back portion 36 and a flat straight bottom base portion 38. The opening 32 is approximately seven-eighths of an inch, the bottom base portion 38 approximately five-eighths of an inch, and the back portion 36 approximately five-eighths of an inch. The clamp 30 has a longitudinal axis which extends along the direction of the opening 32 shown in FIG. 2. The arcuately-shaped upper portion 34 has a radius of curvature which approximates the radius of curvature of the basketball hoop and is approximately five-sixteenths of an inch (five-eighths inch diameter). The arcuately-shaped upper portion 34 contributes to the formation of a flange or lip 37 which extends downwardly along the side of the basketball rim 5. The lip or flange 37 helps the clamp 30 grasp and remain on the basketball rim 5.

The bottom base portion 38 of the clamp 30 has a threaded hole 40 therethrough for receiving a set screw 42. The set screw 42 has machine threads which mate and interact with the machine threads formed in hole 40 to allow the screw 42 to be turned in order to press and hold the clamp 30 on the goal; in FIG. 1, the rim 5 of the basketball hoop 10. It can be appreciated that the threaded hole 40 can be formed in different location(s) on clamp 30 or holes in addition to threaded hole 40 can be formed in the clamp 30 to interact with the set screw(s) 42. The end 44 of the set screw 42 may have a plate (FIG. 1), circular knob (FIG. 2), or any other configuration which allows the set screw 42 to be turned. Preferably, the end 44 of the screw 42 is configured to allow the set screw 42 to be hand-tightened onto the goal 10. Alternatively, other fastening devices such as a spring-loaded pin can be utilized to retain clamp 30 on the rim 5 of the basketball hoop 10.

It is preferred that the clamp 30 be adapted and configured to be removably attached to all basketball rims including the older style and the new style which has a rounded edging of material underneath the rim and which is used to attach the net to the rim. In the newer style rim with the extra piece of rounded edging on the underside of the rim, it is advantageous to have a threaded hole 40 formed diagonally in the corner where the bottom base portion 38 and back portion 36 meet. The set screw or fastening device 42 then protrudes through the hole 40 and presses diagonally into both the rim and the rounded bottom edging. In this circumstance, lip 37 is advantageous because it retains the clamp 30 on the rim 5.

The clamp 30 may be made of any material which has the requisite strength and durability characteristics such that when it is hit by a game piece, it will not break, crack, fail or be damaged. An example of a suitable material is three-eighths inch steel, aluminum or plastic machined or molded to have an opening 31 as described above or any other configuration which will allow its attachment onto the goal. In the case of FIGS. 1 and 2, basketball hoop 10.

An elongated member 50 extends substantially straight from and in the direction of the longitudinal axis of the clamp 30 without any major bends or curved portions. The elongated member 50 has a bulk or ball of material 60 attached to the end 52 of elongated member 50 which is not attached to the clamp 30. The ball 60 forms a target for the shooter and should be made of any material which has the requisite strength and durability characteristics such that it will not fail, break, crack or be damaged and, preferably, will not be marred when struck by a game piece. In a similar manner, the ball of material 60 should not crack, break or damage, and, preferably, should not mar the game piece. A soft, deformable resiliently elastic material is preferred for ball 60 and rubber has been found to be a suitable material. The ball 60 may be configured into any suitable shape, and it is preferred that the ball 60 be sized, configured and colored to be highly visible. A spherical ball such as illustrated in FIGS. 1 and 2 made of rubber and sized to be larger than the elongated member 50 and colored differently than the elongated member 50 and, preferably, a bright color has been successful for basketball. The ball 60 may be attached to the elongated member 50 by any suitable means such as drilling a hole in the ball 60 and securing it onto the elongated member 50 by a force-fit or screwing or, alternatively, using a screw, rivet, pin fastener or any like fastening device. Alternatively, the ball 60 may be connected to the elongated member 50 by bonding or gluing, and also may be formed integrally with the elongated member 50.

The elongated member 50 is made of resilient flexible material such that it will withstand the shock of flying game pieces and will deflect, flex and deform when the ball 60 is struck or impacted by a game piece in a manner which will allow the ball 60 to move or deflect out of the path of the game piece without substantially altering the game piece's trajectory. The elongated member 50 returns to its initial position after the game piece has passed so that the ball forming the target returns to its original position after being struck by the game piece. The elongated member 50 is formed of a material and sized and configured to withstand the force and impact of the game piece of the sporting event for which the device 20 is designed. Examples of materials suitable for elongated member 50 include rubber, plastics, urethanes, coiled metal springs or a combination of these materials.

The elongated member 50 may be attached to clamp 30 by any appropriate means such as for example forming a hole 54 through elongated member 50 which will mate and communicate with a hole 35 in clamp 30 and inserting a pin 41 which extends through holes 35 and 54 to hold elongated member 50 to clamp 30. The elongated member 50 also may be bonded or glued to the clamp 30.

Alternatively, and in addition to, the elongated member 50 may be attached to the clamp 30 in a manner which allows it to move, pivot or deflect when the ball 60 is struck by the game piece so that the ball allows the game piece to pass without substantially affecting the trajectory of the game piece. After the game piece has deflected the ball 60 and passed through the hoop, the elongated member 50 returns to its original position to set up the target (ball 60) for the next shot.

When device 20 is configured for use with a basketball hoop 10, the elongated member 50 and ball 60 are configured so that distance "L" shown in FIG. 2 is approximately two to approximately four inches so that when the device 20 is placed on the rim 5, the ball 60 forming the target is approximately two to approximately four inches directly above the rim. In the embodiments shown in FIGS. 1 and 2, elongated member 50 is approximately one and one-half inches long, cylindrical in shape with a half-inch diameter and made of black neoprene rubber having a durometer of 70A. The ball 60 is spherical in shape with a one and one-half inch diameter and is made of bright yellow rubber having a softer durometer than the elongated member 50.

When using the device 20 for basketball, it should be placed on the front of the rim 5 so that the shooter aims at the target member 60 which is positioned directly above the front of the rim 5. When shooting a basketball, a player aims for and shoots at the ball 60 forming the target member. The ball 60, which is approximately two to four inches and, more preferably, approximately three inches higher and directly above the front of the rim 5 not only will give the shooter a highly visible target but will teach the art of shooting over the front of the rim, not at it. The shooter using the device 20 over time will develop a sense of where and how to shoot the basketball and greatly improve his/her shooting skills. In fact, in time and with enough use, the shooter will be able to mentally visualize the target even when the device 20 is not actually attached to the hoop.

Figure 3:
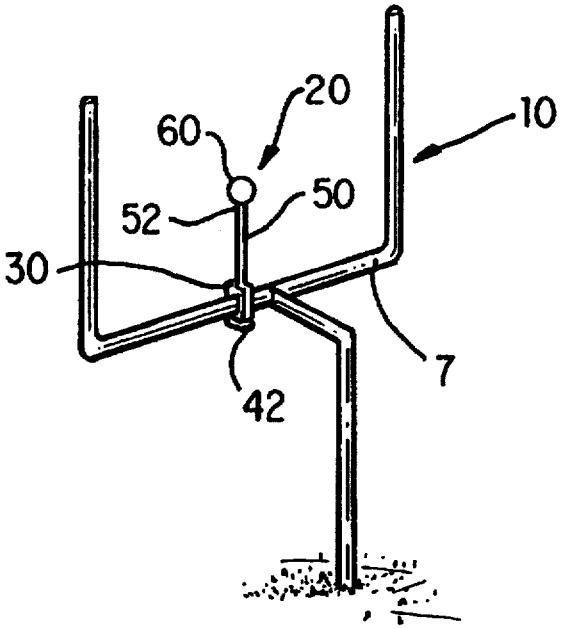
FIG. 3 is a perspective view of a different embodiment of the invention mounted on a football goalpost.

Referring to FIG. 3, device 20 has been dimensioned, configured and adapted for a football player kicking field goals. The clamp 30 and its openings 31 and 32 are dimensioned and configured to attach to a football field goalpost. An opening 32 of four to five inches should be suitable. In this embodiment, the dimension "L" shown in FIG. 2 will be adapted specifically for kicking field goals and may be from about one to about twelve feet and preferably from about six to about nine feet in order to place the bulk of material or target member 60 in a location above the horizontal bottom goalpost 7 which is suitable for kicking field goals. The elongated member 50 preferably may be adjustable in length so that the bulk of material 60 can be properly adjusted for kicking field goals and also easily collapsible for transport. The size of the bulk of material 60 may be increased as compared to the embodiment used for basketball, for example to a sphere having a one-foot diameter, and its shape changed to provide a more visible target for the field goal kicker. The diameter (width) of elongated member 50 is also sized in this embodiment to account for the added length and increased size of the bulk material 60.

The elongated member 50 of the embodiment used for football may be resiliently flexible such that it bends when it or the target 60 is struck or alternatively the connection of the elongated member 50 to the clamp 30 may be such that elongated member 50 moves in a manner which does not materially alter the trajectory of the football when the elongated member 50 or target member 60 is struck by the football. Elongated member 50 may be formed of rigid tubular sections which may be connected to a spring or resilient flexible materials connected together. Alternatively, or in addition to, telescoping concentric cylinders of material may be used for elongated member 50.

The device 20 of FIG. 3 provides a target or focus for the field goal kicker to aim at as opposed to an empty area between the two uprights of a goalpost. In this manner, the field goal kicker will obtain a sense of where to aim when kicking and will improve his/her kicking accuracy and skills. After obtaining the sense of where to aim, the kicker will be able to kick more accurately even when the device 20 is not in place because of the mental image retained by the kicker.

Figure 4:
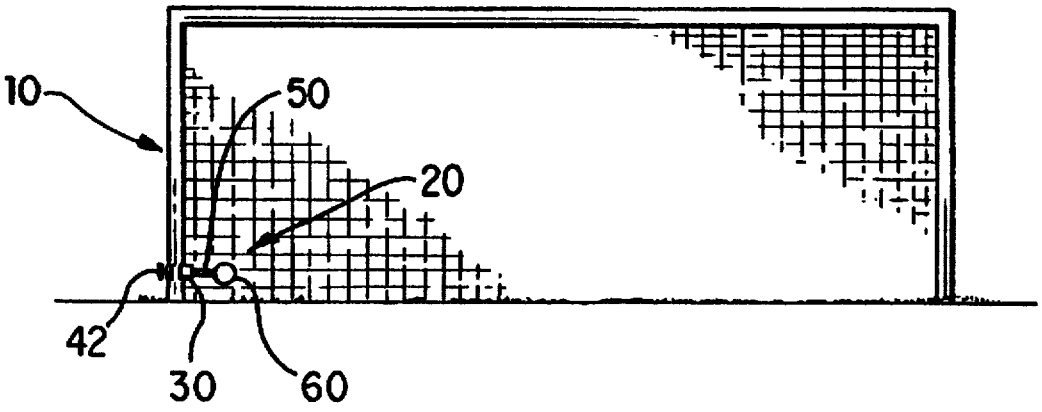
FIG. 4 is a perspective view of a different embodiment of the invention mounted on a soccer goal.

Referring to FIG. 4, the device 20 has been configured and adapted for attachment to a soccer goalpost. In this embodiment, clamp 30 is configured and adapted to attach to a goalpost or crossbar of soccer goal 10. The shape of the opening 31 in clamp 30 may be configured specifically to fit a crossbar or goalpost having a square cross-section as is sometimes provided with soccer goals. The elongated member 50 and ball 60 are configured and adapted to place the ball 60 within the plane formed by the goalposts and the crossbar and at a location approximately one foot from the end surface 34 of the clamp 30. The materials of elongated member 50 and bulk of material 60 are chosen so that they can withstand the shock of flying soccer balls. In use, the device 20 may be placed in the lower corners or any other desirable location of the soccer goal to provide a target for the shooter.

Again, by providing a target for the player to aim at instead of an empty space between goalposts and crossbars, the player develops a feel and a sense of where to aim when shooting at the goal and improves his/her shooting ability. After using the device 20 for a period of time, the player should be left with a metal impression of the target and, thus, be able to improve his/her accuracy even when the device is not actually connected to the goal.

It can be appreciated how device 20 can be adapted for a hockey goal, lacrosse goal and other sports where shooting accuracy comes into play. The device 20 likewise can be adapted for use in tennis, for instance by attaching it to the net or supporting structure of the net and placing the bulk of material or target member 60 several inches above the net thus providing the tennis player with a target to aim at when hitting (serving or returning) the tennis ball.

Figure 5:
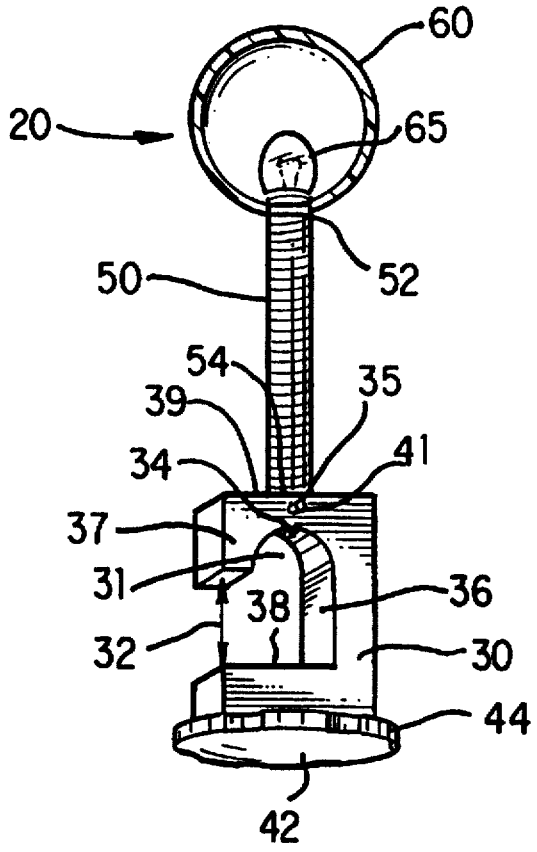
FIG. 5 illustrates a perspective view of the device of FIG. 2 with a cross-section of the target incorporating a light.

A further embodiment of device 20 includes using a light 65 (see FIG. 5) and, preferably, a flashing light as the target member 60 or incorporating a light and, preferably, a flashing light into the bulk member 60 so that the target is highly visible. This feature is particularly advantageous for those sports where the goal is at a distance from the player.

An advantage of device 20 is that it can be used during practice drills, scrimmages or games without substantially interfering with the game. Because of its simple construction and direct attachment to the goal, the game will be substantially unaffected by its use. In addition, because it readily can be attached and detached to the goal, the device 20 can be removed easily or set up depending upon the player's desire.

Although particular embodiments of the invention have been described and illustrated herein, it is recognized that modifications and variations readily may occur to those skilled in the art and, consequently, it is intended that the claims be interpreted to cover such modifications and equivalents.

I claim:

1. A basketball shooting aid device attachable to a basketball rim for improving the accuracy and shooting form of a player by providing a visual target to aim at and strike with the basketball comprising:

a clamp having an inner surface which contacts the basketball rim and an oppositely facing exterior surface, the clamp configured and adapted to removably attach to the basketball rim;

a substantially straight elongated member having first and second ends, the elongated member connected adjacent its first end to the clamp and extending substantially perpendicular from the exterior surface of the clamp such that its second end is located at a point distal from the clamp; and a three-dimensional bulk member connected adjacent the second end of the elongated member to form a target for the player to aim and attempt to strike with the basketball, wherein the elongated member is configured and adapted to (a) place the bulk member in the range of approximately two to approximately four inches directly above the rim, (b) deflect when the bulk member is struck by the basketball so that the bulk member moves without substantially altering the trajectory of the basketball and (c) return the bulk member to its original position after it has been deflected by the basketball.

2. The device of claim 1 wherein the bulk member is substantially a sphere having approximately a one and one-half inch diameter and is made of rubber and the elongated member is substantially cylindrical in shape having an approximately half-inch diameter and extending approximately one and one-half inches from the clamp.

3. The device according to claim 2 wherein the clamp comprises a substantially C-shaped base portion having an opening adapted to fit over a basketball rim and a set screw for tightening the base portion to the rim.

4. The device according to claim 3 wherein at least a portion of the elongated member is resiliently flexible such that it will (a) bend when the target member is struck in a manner which allows the basketball to pass through the basketball hoop without substantially altering the basketball's trajectory and (b) unbend to its substantially straight configuration to return the target member to its original Position after the target has been struck by the basketball.

5. The device according to claim 1 wherein the elongated member is integral with the bulk member.

6. A device specifically adapted and configured to attach to a football goalpost for improving the accuracy and kicking form of a player by providing a visual target to aim at comprising a clamp configured and adapted to removably attach to the goalpost; an elongated member having first and second ends, the elongated member connected adjacent its first end to the clamp and extending substantially perpendicular from the clamp such that its second end is located at a point distal from the clamp; a bulk member connected adjacent the second end of the elongated member to form a target for the player, wherein the elongated member is configured and adapted such that the elongated member: (a) deflects when the bulk member is struck by the football without substantially altering the trajectory of the football; (b) returns the bulk member to its original position after it has been deflected by the football; and (c) places the bulk member in the range of approximately three to approximately twelve feet above the horizontal bottom goalpost.

7. The device of claim 6 wherein the bulk member is spherical with a diameter of approximately one foot.

8. The device of claim 6 wherein the elongated member comprises at least one rigid tubular member and a spring.

9. The device of claim 8 wherein the rigid tubular members are connected in series and collapse telescopically.

10. The device of claim 6 wherein the elongated member comprises at least one resilient tubular member.

11. The device of claim 10 wherein the at least one resilient members are connected in series and collapse telescopically.

12. The device of claim 6 wherein the bulk member is a different color than the elongated member.

13. The device of claim 6 wherein the bulk member includes a light.

14. In combination with a basketball hoop which includes a rim, a basketball shooting aid for improving the shooting accuracy and form of a basketball player by providing a visual target directly over the front of the rim for the player to aim at and strike with the basketball comprising:

(a) a base having an opening configured and adapted to fit over and onto a basketball rim;

(b) a fastener interacting with the base to removably attach the base to the rim;

(c) a substantially straight elongated member having first and second ends, the elongated member connected adjacent its first end to the clamp and extending from the base such that its second end is at a point distal from the base; and (d) a target member attached adjacent the second end of the elongated member for the basketball shooter to aim at and strike with the basketball;

wherein the elongated member and target member are adapted and configured to (a) locate the target member in the range of approximately two to approximately four inches directly above the rim and (b) deflect when struck by the basketball so as not to substantially alter the basketball's trajectory and (c) return the target member to its initial location directly above the rim.

15. The device of claim 14 wherein the elongated member is resiliently flexible such that it will (a) bend in order to displace the target member when the target member is struck by the basketball in a manner which allows the basketball to pass through the hoop without substantially altering the basketball's trajectory and (b) unbend to its substantially straight configuration to return the target member to its original position after the target has been struck by the basketball.

16. The device according to claim 15 wherein the elongated member at least partially is formed of rubber.

17. The device according to claim 15 wherein the elongated member at least partially is formed by a coil spring.

18. The de vice according to claim 15 wherein the target member is spherical having a diameter which is larger than the largest width dimension of the elongated member.

19. The device of claim 15 wherein the target member is made of a soft, deformably elastic material and is colored differently than the elongated member.

20. A method of teaching a basketball player improved form and accuracy in shooting basketballs comprising the steps of:

(a) providing at least one basketball shooting aid device comprising a removably attachable clamp for mounting the device onto the basketball rim, a substantially straight elongated member having first and second ends, the elongated member connected adjacent its first end to the clamp and extending from the clamp so that its second end is located at a point distal from the clamp, a highly visible three-dimensional target member attached adjacent the second end of the elongated member, the target member forming an aiming point at which the basketball player shoots, the center of the target member in the range of approximately one to approximately three inches away from the clamp, wherein the elongated member is adapted and configured so that it will deflect in order to displace the target member in a manner which allows the basketball to pass through the hoop without substantially altering the trajectory of the basketball when the target member is struck by the basketball and returns the target to its original position after the target member is struck by the basketball;

(b) mounting at least one of said basketball shooting devices on a portion of the rim which is nearest to the shooter and in a manner which places the target member approximately two to approximately four inches substantially directly above and not substantially laterally outwardly of the rim; and (c) instructing the shooter to aim and strike the target member so that the player masters shooting over the front of the rim.

21. A basketball shooting aid removably attachable to a basketball hoop which includes a rim for improving the shooting accuracy and form of a basketball player by providing a visual target directly over the front of the rim for the shooter to aim at and strike with the basketball comprising:

(a) a clamp configured and adapted to removably attach directly to a basketball rim;

(b) a substantially straight elongated member having first and second ends, the elongated member connected adjacent its first end to the clamp and extending from the clamp such that its second end is located at a point distal from the clamp; and (c) a three-dimensional target member adjacent the second end of the elongated member to form a target for the player to aim and attempt to strike with the basketball, wherein the clamp, elongated member and target member are configured and adapted to locate the target in the range of approximately two to approximately four inches directly above the rim when the clamp is attached to the rim.

22. The device of claim 21 wherein the elongated member is configured and adapted such that it (a) deflects when the target member is struck by the basketball so that the target member moves without substantially altering the trajectory of the basketball and (b) returns the target member to its original position after it has been deflected by the basketball.

23. The device of claim 22 wherein the elongated member at least partially is made of a material which is resiliently flexible such that it will (a) bend when the target member is struck in a manner which allows the basketball to pass through the basketball hoop without substantially altering the basketball's trajectory and (b) unbend to its substantially straight configuration to return the target member to its original position after the target has been struck by the basketball.

24. The device of claim 23 wherein the elongated member at least partially is made of rubber having a durometer of 70 A.

25. The device of claim 23 wherein the elongated member at least partially is formed of a coil spring.

26. The device of claim 23 wherein the elongated member consists of a single unitary piece fixedly connected to the clamp and extending substantially perpendicular therefrom.

27. The device of claim 23 wherein the clamp comprises:

a base portion having an opening formed therein dimensioned and sized to fit over the basketball rim, the base portion having a substantially C-shaped inner surface which includes an arcuately-shaped upper portion which fits over the top of the rim and forms a lip which extends downwardly along the side of the basketball rim, a substantially straight back portion and a substantially straight flat bottom portion; and a fastener interacting with the base portion to removably attach the base portion to the basketball rim.

28. The device of claim 27 wherein the base portion has a threaded aperture and the fastener is a screw which interacts with the aperture such that the screw holds the clamp on the basketball rim.

29. The device of claim 28 wherein the substantially straight back portion of the inner surface of the base portion meets at a right angle with the substantially straight flat bottom portion of the inner surface of the base portion to form a corner, the aperture being formed diagonally through the corner where the bottom and back portions of the inner surface of the base portion meet.

30. The device of claim 27 wherein the accurately-shaped inner surface of the base portion has a radius of curvature of approximately five-sixteenths of an inch.

31. The device of claim 27 wherein the base portion has an inner surface which makes contact with the basketball rim and an opposite exterior surface and the elongated member extends substantially perpendicular from the exterior surface of the base portion.

32. The device of claim 22 wherein the elongated member is substantially cylindrical in shape having an approximately half-inch diameter and being approximately one to two inches in length.

33. The device of claim 32 wherein the target member is substantially a sphere having approximately a one and one-half inch diameter and made of rubber which is softer and a different color than the elongated member.

34. A basketball shooting aid removably attachable to a basketball hoop which includes a rim for improving the accuracy and form of a basketball player by providing a visual target directly over the front of the rim for the shooter to aim and strike with the basketball comprising:

(a) a clamp configured and adapted to removably attach directly to a basketball rim, the clamp having an inner surface which makes contact with the basketball rim and an oppositely facing exterior surface;

(b) a substantially straight elongated member having first and second ends, the elongated member fixedly connected adjacent its first end to the clamp and extending substantially perpendicular from the exterior surface of the clamp such that its second end is located at a point distal from the clamp; and (c) a three-dimensional target member adjacent and fixedly secured to the second end of the elongated member to form a target for the player to aim and attempt to strike with the basketball, wherein the clamp, elongated member and target member are configured and adapted to locate the target member in the range of approximately two to approximately four inches directly above the rim and the elongated member is at least partially made of a material which is resiliently flexible such that it will (1) bend when the target member is struck in a manner which allows the basketball to pass through the hoop without substantially altering the basketball's trajectory and (2) unbend to its substantially straight configuration to return the target member to its original position after the target has been struck by the basketball.

35. A method of practicing football goal kicks comprising:

(a) providing a device configured and adapted to attach to a football goalpost comprising a clamp configured and adapted to removably attach to the goalpost; an elongated member having first and second ends, the elongated member connected adjacent its first end to the clamp and extending substantially perpendicular from the clamp such that its second end is located at a point distal from the clamp; a bulk member connected adjacent the second end of the elongated member to form a target, wherein the elongated member deflects when struck by the football without substantially altering the trajectory of the football and returns the bulk member to its original position after it has been deflected by the football;

(b) attaching the device to the goalpost, and (c) the player kicking the football toward the bulk member.

36. A football goalpost in combination with a football kicking aid for improving the kicking accuracy and form of a player by providing a visual target between the goalpost bars for the player to aim at and strike with the football comprising:

(a) a clamp configured and adapted to attach to the goalpost;

(b) an elongated member having first and second ends, the elongated member connected adjacent its first end to the clamp and extending substantially perpendicular from the clamp such that its second end is located at a point distal from the clamp;

(c) a bulk member connected adjacent the second end of the elongated member to a form a target for the kicker;

wherein the elongated member deflects when the bulk member is struck by the football and returns the bulk member to its original position after it has been deflected by the football.

* * * * *